United States Patent [19]

Lashley et al.

[11] Patent Number: 4,639,944

[45] Date of Patent: Feb. 3, 1987

[54] ARMOR FOR MOTORCYCLISTS

[76] Inventors: Lester Lashley; R. Craig Lashley; Russel E. Lashley, all of 1209 E. Madison Park, Chicago, Ill. 60615

[21] Appl. No.: 774,938

[22] Filed: Sep. 11, 1985

[51] Int. Cl.[4] ..... A41D 13/00
[52] U.S. Cl. ..... 2/2
[58] Field of Search ..... 2/2, DIG. 6, 2.1 A, 2/2.5, 1, 16, 22

[56] References Cited

U.S. PATENT DOCUMENTS

| | | | |
|---|---|---|---|
| 3,594,817 | 7/1971 | Kelly | 2/2 X |
| 3,653,690 | 4/1972 | Treveiler et al. | 2/2 X |
| 4,179,752 | 12/1979 | Fackelmann | 2/2 |
| 4,416,465 | 11/1983 | Winiecki | 2/2 X |

*Primary Examiner*—Louis K. Rimrodt
*Attorney, Agent, or Firm*—James C. Siekmann; P. Philip Connor

[57] ABSTRACT

A protective armor for a motorcyclist comprises a breast plate, a waist guard, sections of ribbed material for protecting arms, legs and back, and raised ribbed folds to protect knees and elbows.

1 Claim, 3 Drawing Figures

FIG. 1
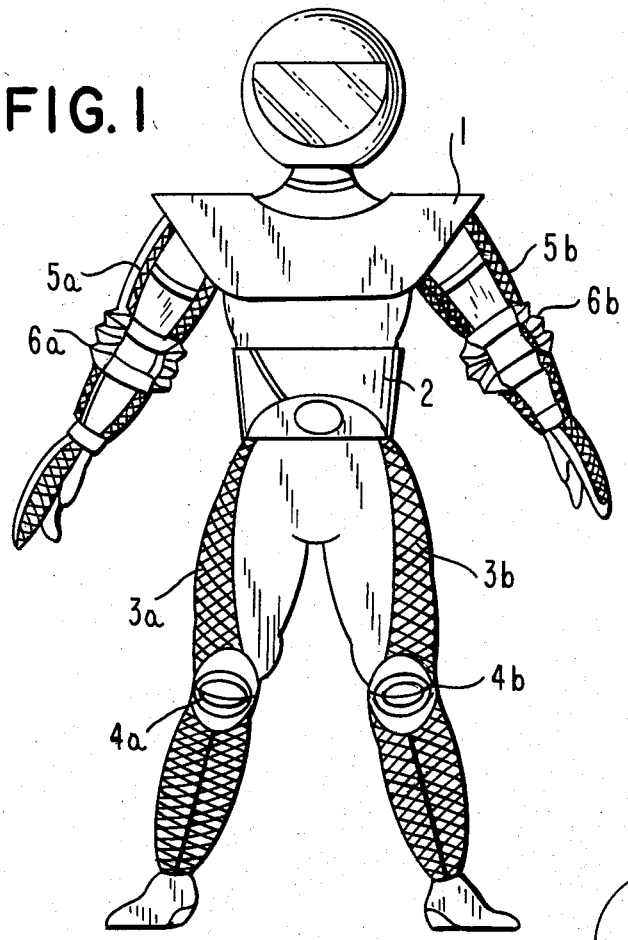
FIG. 2
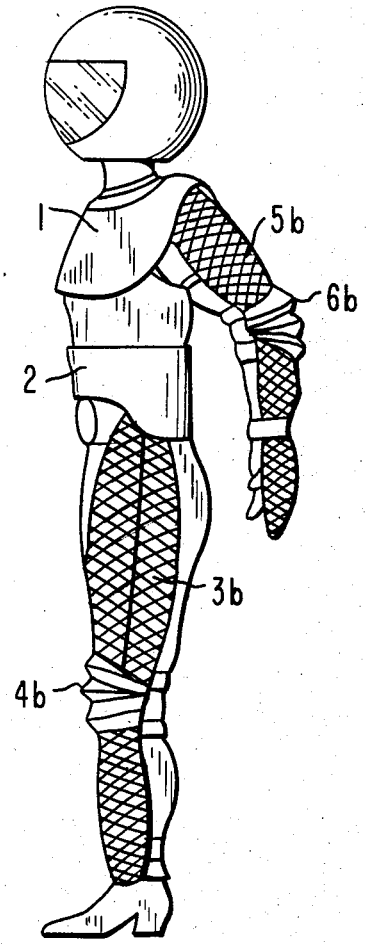
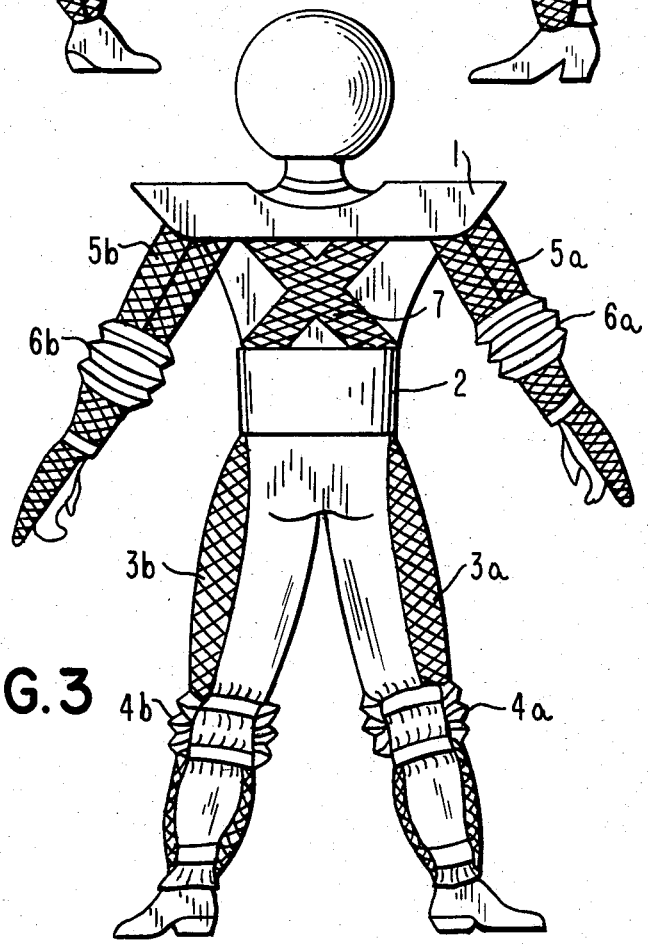
FIG. 3

ARMOR FOR MOTORCYCLISTS

BACKGROUND OF THE INVENTION

1. Field of the Invention

This invention relates to a protective armor for motorcyclists to guard against skin burn and abrasions in the event they are thrown off their motorcycles onto a paved surface.

2. Summary of the Invention

This invention provides a protective armor for a motorcyclist guarding himself against skin burn and abrasions in the event he is thrown off a motorcycle on to a paved surface at high speed. The invention provides a breast plate, a waist guard and sections of ribbed protective fabric for the legs, arms and back, and raised ribbed folds at the knees and elbows.

BRIEF DESCRIPTION OF THE DRAWINGS

FIG. 1 is a front elevational view of a cycle armor system shown in accordance with the present invention;

FIG. 2 is a side elevational view of the cycle armor system, and

FIG. 3 is a rear elevational view of the embodiment of the invention.

DETAILED DESCRIPTION

The protective armor of this invention comprises a breast plate 1, a solid waist guard 2, sections of ribbed fabric 3*a* and 3*b* protecting the outside of the thighs and the front of the legs below the knees, with raised ribbed folds 4*a* and 4*b* made of solid pieces of synthetic material at the knees, ribbed sections of fabric 5*a* and 5*b* to protect and arms and hands, with raised ribbed folds 6*a* and 6*b* protecting the elbows. The back is protected by straps of ribbed material across the back 7.

All the sections of ribbed material are held in place by straps of material having sections of velcro pile. The sections of material protecting the arms, 5*a* and 5*b*, are connected under the breast plate 1 by sections of elastomeric material. The sections of material protecting the legs, 3*a* and 3*b*, are connected under the waist guard 2 by sections of elastomeric material.

The ribs on the protective fabric are $\frac{3}{8}''$ to $\frac{3}{4}''$ deep. The breast plate 1 and the waist guard 2 are made of hard plastic $\frac{1}{4}''$ to $\frac{1}{2}''$ thick. The folds on the protective sections for the knees and elbows are 1/16″ to $\frac{1}{4}''$ deep.

While various changes may be made in the detail construction, it is understood that such changes will be within the spirit and scope of the present invention, as is defined by the appended claims.

What we now claim is:

1. A protective armor for a motorcyclist, comprising, in combination, a breast plate, a waist guard, a plurality of sections of ribbed fabric; said breast plate and said waist guard being made of hard plastic; a pair of said ribbed fabric sections for covering arms and hands including raised ribbed folds at elbows, a pair of said ribbed fabric sections for covering of an outer side of thighs and a front of leg portions below the knees including raised ribbed folds at said knees all said raised ribbed folds being made of solid pieces of polyurethane plastic; elastomeric material connecting an underside of said breast plate and an underside of said waist guard to said ribbed fabric sections, and a pair of crossing straps at the rear being made of said ribbed fabric, and all said ribbed fabric sections being held in place on said motorcyclist by velcro loop fastener means.

* * * * *